US009750324B2

(12) United States Patent
Yun

(10) Patent No.: US 9,750,324 B2
(45) Date of Patent: Sep. 5, 2017

(54) NAIL CLIPPER

(71) Applicant: Woo Sung Yun, Newington, CT (US)

(72) Inventor: Woo Sung Yun, Newington, CT (US)

( * ) Notice: Subject to any disclaimer, the term of this patent is extended or adjusted under 35 U.S.C. 154(b) by 0 days.

(21) Appl. No.: 15/043,372

(22) Filed: Feb. 12, 2016

(65) Prior Publication Data

US 2016/0235182 A1 Aug. 18, 2016

Related U.S. Application Data

(60) Provisional application No. 62/116,153, filed on Feb. 13, 2015.

(51) Int. Cl.
*A45D 29/02* (2006.01)

(52) U.S. Cl.
CPC ..... *A45D 29/02* (2013.01)

(58) Field of Classification Search
CPC . A45D 29/02; A45D 29/023; A45F 2005/008; B26B 27/007
USPC ..... 30/28, 298, 26, 232, 254, 124, 29, 27; 132/75.5, 73.5, 75.4, 73, 25.5, 75.3; D28/60
See application file for complete search history.

(56) References Cited

U.S. PATENT DOCUMENTS 927,058 A * 7/1909 Krouse ..... B26B 13/20 30/266
970,067 A * 9/1910 Leineweber ..... A45D 29/02 30/232
1,992,917 A * 2/1935 Kirst ..... C09B 43/36 534/655
3,997,966 A * 12/1976 Sartore ..... A45D 29/023 30/28
4,196,514 A * 4/1980 Merriman ..... A45D 29/023 30/124
5,384,960 A * 1/1995 Tottenham ..... A45D 29/02 132/75.5
5,438,819 A * 8/1995 Dallman ..... A01D 34/73 56/17.5
5,531,025 A * 7/1996 Albone ..... A45D 29/02 132/75.5
2004/0200073 A1* 10/2004 Sakai ..... A45D 29/02 30/28
2006/0010695 A1* 1/2006 Wu ..... B26B 13/20 30/232

* cited by examiner

*Primary Examiner* — Ghassem Alie
(74) *Attorney, Agent, or Firm* — Park & Associates IP Law, P. C.

(57) ABSTRACT

A nail clipper includes a clipper body with a pair of jaws, a lever configured to move the jaws to cut nail, a thumb ring member rotatably mounted to the lever, the thumb ring member having first and second ring members, each defining an inner opening through which a thumb of the user can be introduced. The nail clipper further includes a connection plate member which is formed unitarily with the first and second ring members into one piece and connecting between the lower portions of the first and second ring members, wherein the connection plate member has a planar upper surface and includes a bore formed vertically there-through, and a fastener is coupled to the bore of the connection plate member and allows the thumb ring member to freely rotate relative to the lever.

10 Claims, 7 Drawing Sheets

NAIL CLIPPER

REFERENCE TO RELATED APPLICATIONS

This application claims the priority benefit of U.S. Provisional Patent Application No. 62/116,153 filed on Feb. 13, 2015, the entire contents of which are incorporated herein by reference.

FIELD OF THE INVENTION

The present invention relates to a nail clipper having a ring member (in particular, a thumb ring) mounted to a lever member of the nail clipper, in which the ring member is configured to allow a user to insert its thumb thereto, and thus, facilitating easy and firm holding of the clipper with the thumb and other fingers of the user.

BACKGROUND OF THE INVENTION

Nail clippers typically include first and second plate members that are joined together at one end, and having a pair of jaw portions at the opposite end thereof, and an operating lever coupled to the plate members for moving the jaws from an open position to a nail cutting position. The first and second plate members of such conventional nail clippers are made of polished metal materials, and usually have narrow tip portions onto which the thumb and other fingers are to be properly placed to cut finger nails or toe nails of the user. As the metallic tip portions of the plate members are often slippery, and it is burdensome and uncomfortable for the user to securely hold the nail clipper at the narrow and slippery tip portions thereof. As such, the user must operate the nail clipper with care in order not to get an accidental injury when nail cutting.

In an attempt to overcome such shortcomings or inconvenience in the conventional nail clippers, U.S. Pat. No. 5,384,960 to Tottenham proposed a nail clipper structure (see FIG. 8) with a pair of ring members 24 and 38 attached to the nail clipper 10. More specifically, in this nail clipper design, a first ring 24 is attached to the operation lever 20, and a second ring 38 is attached to the clipper body (i.e., the combination of 12 and 14) for facilitating easy grasping the nail clipper. One advantage of this nail clipper is that the use may grasp the nail clipper more securely as the thumb and another finger (generally, the index finger) are inserted into the two ring members, and thus, the nail clipper can hardly escape from the hand of the user, and reducing the risk of injury to the user. However, since this nail clipper allows only one finger (e.g., the index finger) to the bottom ring member, it is not ideal and causes inconvenience or discomfort to the user. This is at least because the pressure that is put solely on one finger (e.g., index finger) can cause discomfort on the finger. Moreover, as each of the rings is formed with one ring member, the contact areas for the fingers (namely, the contact area at the tip of the connection pin 16 to which the rings are attached) are limited in space (see FIG. 8). Thus, this nail clipper can produce excessive pressure onto the respective contacting fingers (i.e., the thumb and the index finger) that are respectively inserted to the two ring members for operation. In addition, as two fingers (i.e., the thumb and the index finger) of the user's hand are required to be inserted to the two rings 24 and 38, the gripping posture for grasping the nail clipper is limited by this restriction, and thus, this causes inconvenience to the user.

SUMMARY OF THE INVENTION

Accordingly, the present invention has been made to solve the above-mentioned problems or shortcomings occurring in the prior art nail clippers, and the present invention is contemplated to provide a nail clipper which is simple in design, and reliable and durable in structure, while also allowing the user to safely and comfortably operate the device. For this, the nail clipper of the present invention utilizes only one ring member, namely, a thumb ring with double ring structure, to provide secured hold of the nail clipper with the thumb inserted in the thumb ring, while allowing the clipper body to be firmly held with two or more fingers, such as the index finger, the middle finger, and others. In this manner, the nail clipper can be firmly held in more natural and comfortable way since two or more fingers are used to firmly support and grasp the bottom side of the nail clipper in cooperation with the thumb which is securely inserted to the double thumb ring attached to the operation lever. Thus, this design can provide more control in operation and comfort since multiple fingers are used for firmly grasping the clipper body member that can distribute pressure among the multiple fingers.

Moreover, the thumb ring of the present invention has a double ring structure with two rings in parallel relation with each other, and with a connection plate having a predetermined width for connecting to bridge between the lower portions of the two ring members, a wider and planar contact area onto which the thumb of the user applies pressure can be provided in the connection plate. Accordingly, the nail clipper of the present invention can be used without discomfort to the user, especially elderly persons, women, and children. Furthermore, the thumb ring of the present invention is freely rotatable with respect to the lever member to which the thumb ring is attached, and thus, the nail clipper can be positioned on the user's hand and fingers in various different gripping posture—see FIGS. 7A, 7B, and 7C, for example. Thus, this provides further comfort and more control for the user's benefits.

Moreover, the operating lever unit (that is, the combination of the operation lever and the thumb ring) of the present invention is designed to have a standardized lever thickness (e.g., 1-2 mm), and the distal tip area (including the hook opening) of the lever is also sized to have standardized dimensions to enable the users to replace, without difficulty, the operation levers of their existing nail clippers with the operation lever units of the present invention. Moreover, the ring member is also designed to be easily replaced with a new one when desired, utilizing the re-attachable fasteners coupling the ring member to the lever. Thus, the users can also have a high degree of freedom in selection, in addition to the convenience and comfort in operation.

According to one preferred embodiment of the present invention, the nail clipper comprises: a clipper body formed with first and second clipper body members, said first and second clipper body members each having a matching jaw portion at a distal portion thereof for clipping operation; a lever member configured to move said match jaw portions from an opened position to a cutting position for cutting a nail inserted between said matching jaw portions; a thumb ring member rotatably mounted to a proximal end of the lever member, the thumb ring member including first and second ring members, said first and second ring members each having a generally circular, elliptical or oval ring shape with an inner opening through which a thumb of a user can be introduced for clipping operation, the first and second ring members disposed in parallel relation to each other.

The thumb ring member further comprises a connection plate member of a predetermined width and length, said connection plate member formed unitarily with the first and second ring members into one piece, and thereby connecting and bridging between a lower portion of the first and second ring members, the connection plate member having a planar upper surface and including a bore formed vertically through the connection plate member, and a fastener coupled to the bore of the connection plate member and allowing the thumb ring member to freely rotate relative to the lever member.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Figure 1:
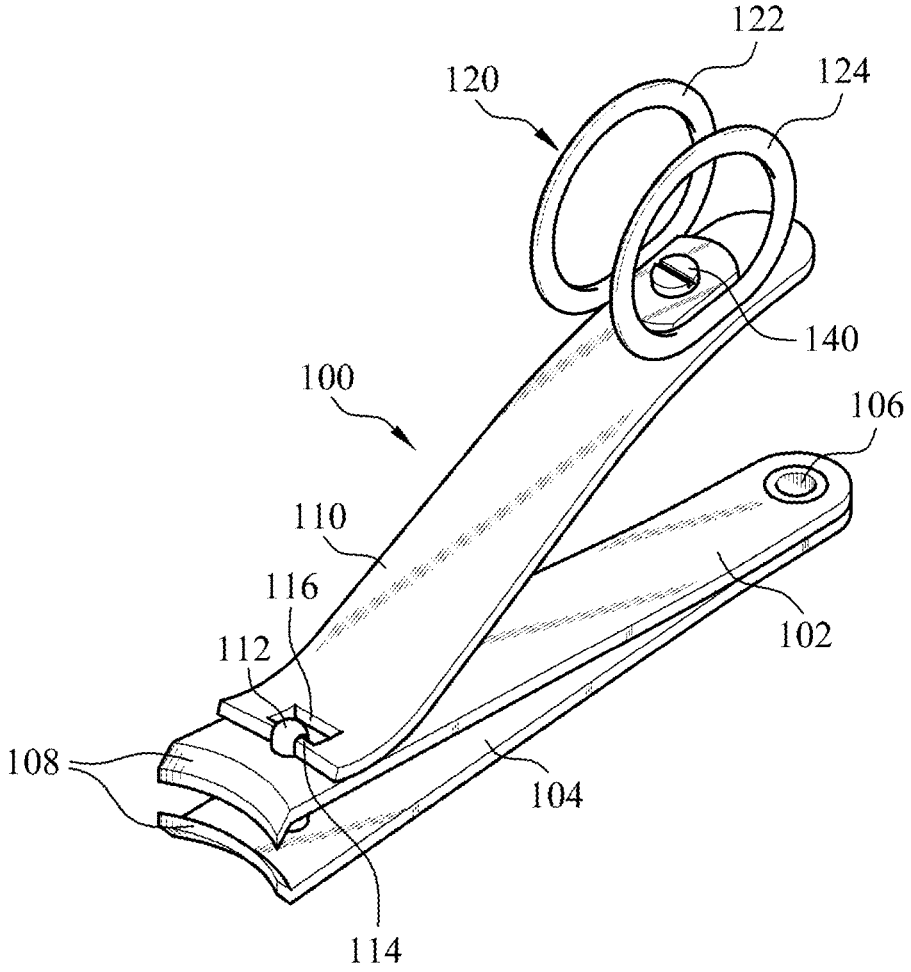
FIG. 1 is a perspective view of the nail clipper according to a preferred embodiment of the present invention, with the ring member in a first operating position.

Referring to the drawings, the nail clippers of the present invention are described herein in detail in association with exemplary or currently preferred embodiments thereof. However, the following descriptions of such embodiments are intended primarily for illustrating the principles and exemplary constructions of the nail clippers of the present invention, and the present invention is not specifically limited to these exemplary embodiments. Thus, one skilled in the art can appreciate or recognize that various modifications and substitutions can be made thereto without departing from the spirit and scope of the present invention. Throughout the disclosure, the same or similar elements and portions thereof are referred and described with the same reference characters for the simplicity and illustrative purposes.

Figure 2:
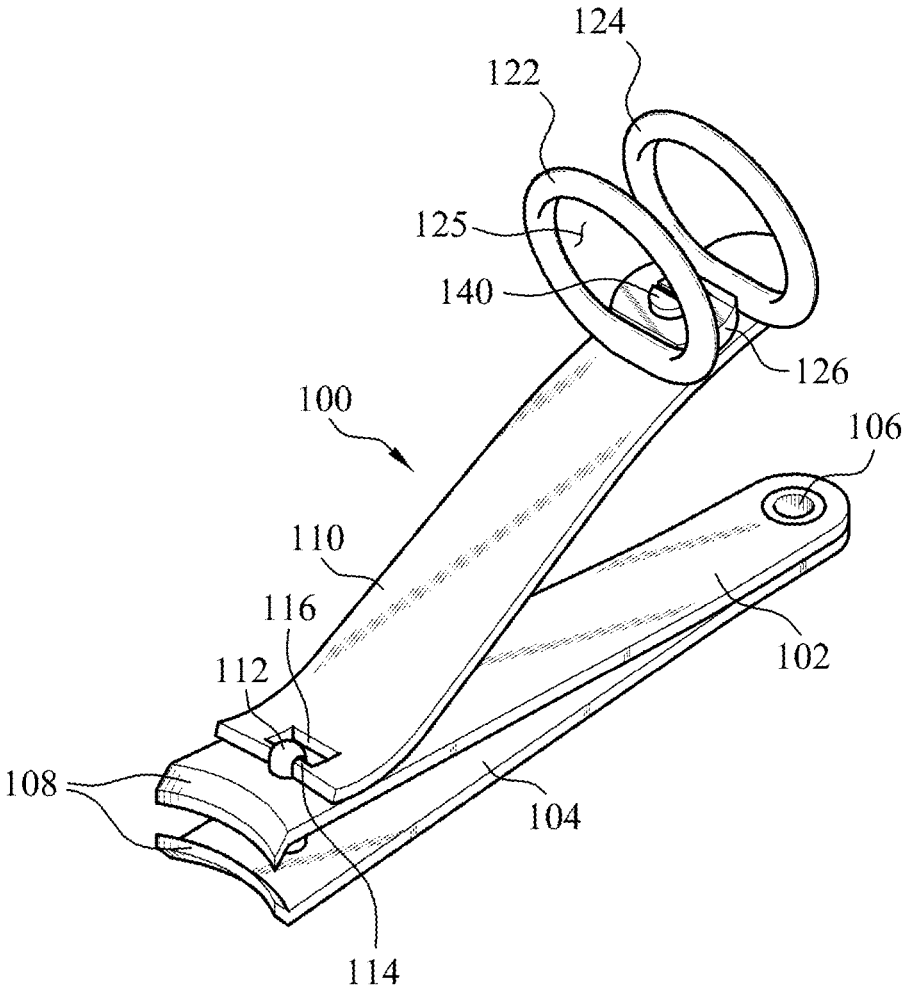
FIG. 2 is a perspective view of the nail clipper of FIG. 1, with the ring member in a second operating position.

With reference to FIGS. 1 and 2, the nail clipper according to one preferred embodiment of the present invention is described herein below. As depicted in the drawings, the nail clipper 100 includes a first clipper body member 102 and a second clipper body member 104 coupled together at a first end by a pin member 106 or by other known coupling elements, such as rivets, coupling screws, and the like. Each of the body members 102 and 104 has a cutting jaw 108 at a second end opposing to the first end, and is configured to cut nails upon operation. These members are configured such that the cutting jaws 108 are normally in a spaced apart relationship, and can be moved into a cutting position as the user operates the nail clipper.

For clipping operation, the nail clipper 100 includes an operating lever 110 connected to a pin or hook member 112 which extends through a set of bores formed at the second end of the first and second clipper body members 102 and 104. A distal tip of the operating lever 110 is coupled to the hook member 112 so that the lever 110 can be rotated between the operating position (shown in FIGS. 1 and 2) and the retracted or storing position (shown in FIG. 5). The hook member 112 includes a hooking groove 114, and a distal tip of the lever 110 (where a hook opening 116 is located) is engaged to the hooking groove 114. In the operating position, the lever 110 contacts the upper surface of the first body member 102 to provide a leverage effect, and is capable of causing the jaw portions to move towards each other to cut or trim an object (e.g., finger nails or toe nails) inserted between the jaw portions.

The nail clipper 100 further includes a ring member 120 which is rotatably mounted to a proximal tip portion of the operating lever 110. The ring member 120 preferably has a double ring structure composed with a first ring 122 and a second ring 124 disposed in parallel relation to each other, each ring 122 and 124 having a generally circular ring shape, defining a generally circular, oval, elliptical or similarly-shaped opening 125 with a dimension suitable for the thumbs of users to be introduced without having much clearance. It is noted that the ring member 120 can be provided in different ring sizes (e.g., small, medium, and large sizes) to meet the size of the thumb of the particular user.

Figure 3:
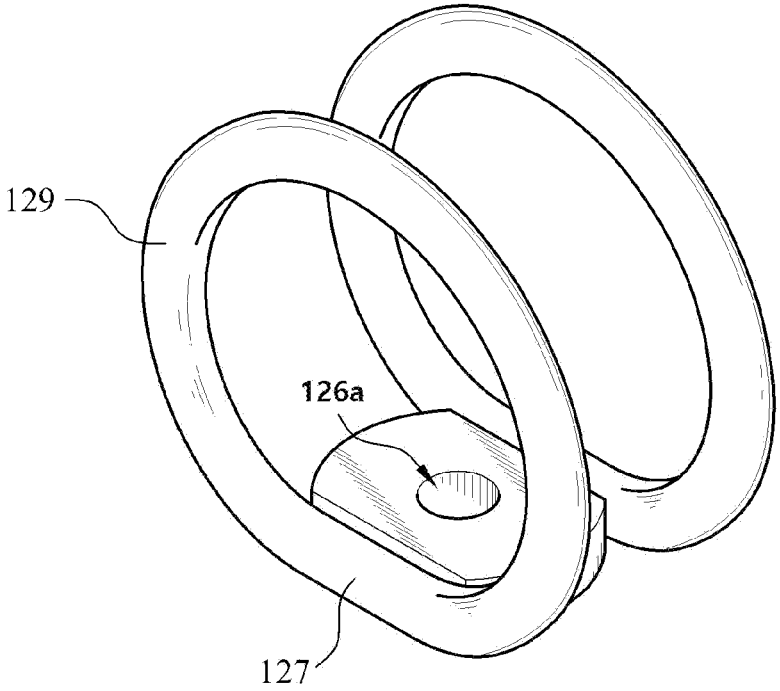
FIG. 3 is a perspective view illustrating the ring member of FIGS. 1 and 2.

The two rings 122 and 124 are displaced to have a predetermined gap there-between, and a connection plate 126 with the same width as that of the parallel gap is unitarily connected to bridge the lower sides of the two parallel rings 122 and 124. For this, each ring 122 and 124 preferably includes a relatively linear region 127 in addition to a generally circular region 129, as shown in FIG. 3.

Figure 4A:
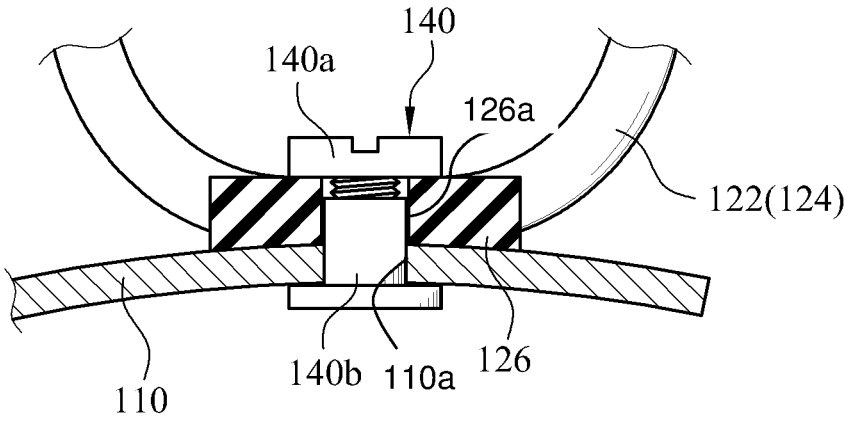
FIG. 4A is a sectional view illustrating the coupling structure of the lever member and the ring member of FIG. 1, with the section taken along the center line between the two ring portions of the ring member.

The upper surface of the connection plate 126 can provide a suitably-sized planar surface area to which a fastener 140 of relatively wide and planar contact surface is to be coupled as shown in FIGS. 1, 2 and 4A, in which the contact surface of the fastener is used for the thumb of the user to apply pressure toward the clipper body (102 and 104) for the clipping operation. Thus, the user can cut its nails comfortably owing to the wide and relatively planar contact surface of the fastener 140. As will be described below in detail in connection with FIG. 4B, the head portion of the fastener 140 can be received in a counter bore formed in the connection plate 126 to provide an enlarged contact surface on the connection plate 126.

In order to mount the ring member 120 to the lever 110, the connection plate 126 comprises a bore or hole 126*a* (shown in FIG. 4A) to which the fastener 140 passes through for coupling thereto. The fastener 140 preferably includes a male fastener member (or screw) 140*a* with a planar head portion as discussed above, and a female fastener member (or nut) 140*b* configured to pass through the bore 126*a* of the connection plate 126 and a corresponding bore 110*a* of the lever 110 in order to securely fasten to the male fastener 140*a*.

Figure 4B:
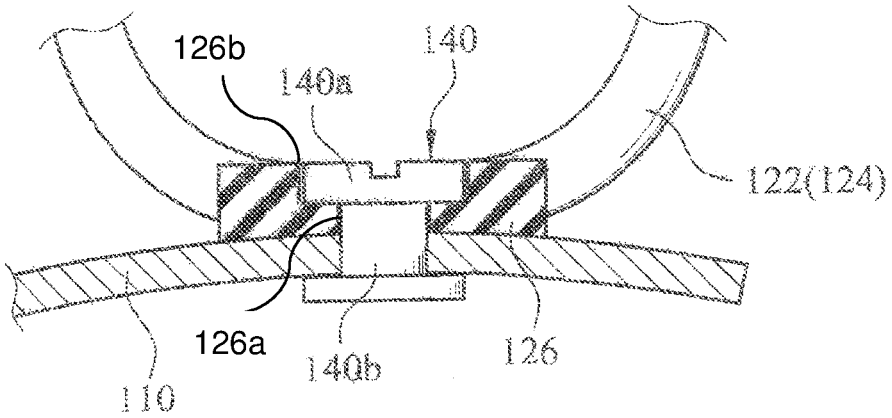
FIG. 4B is a sectional view similar to FIG. 4A and illustrating a modified coupling structure thereof, with the connection plate of the ring member modified to provide a counter bore into which the head of the male coupling screw is introduced to provide a wider and planar contact area for the thumb to contact.

According to another preferred embodiment of the present invention as shown in FIG. 4B, the connection plate 126 is modified to include a counter bore 126*b* at an upper side of the coupling hole 126*a*, and the head portion of the male fastener 140*a* is completely inserted to the counter bore 126*b* with its upper surface flush with the upper surface of the connection plate 126, and thereby, provides a wider and planar contact surface for the thumb of the user to be more comfortably contacted thereto to pressurize the lever 110 for the clipping operation. This embodiment may be more advantageous as the combination of the connection plate 126 and the fastener 140 provides a more spacious horizontal contact surface than that of the nail clipper of FIG. 4A, thus, removing concentrated pressure in use.

Figure 4C:
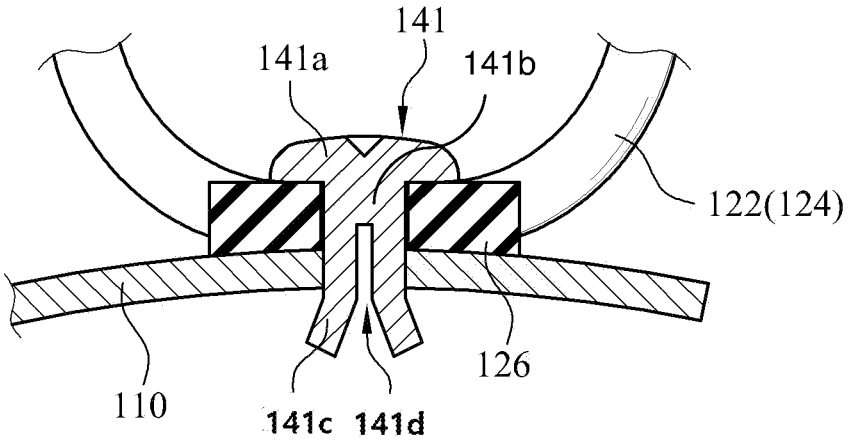
FIG. 4C is a sectional view similar to FIGS. 4A and 4B and illustrating a modified coupling structure thereof, with the ring member coupled to the distal tip of the lever member using a re-attachable or snap-type rivet, instead of using a set of coupling screws.

According to another embodiment of the present invention as shown in FIG. 4C, the fastener member can be in the form of a rivet (e.g., solid rivet, tubular or semi-tubular rivet, split or reusable/re-attachable rivet 141 (as shown in FIG. 4C), and other types of rivets), or it can be other types of fasteners known in the art. In the embodiment shown, the rivet 141 includes a head portion 141*a* and a body portion 141*b*, and the body portion preferably includes two or more leg portions 141*c* with splits 141*d* formed between the leg portions 141*c*. Here, the body portion is formed of elastic or spring materials, and thus, the leg portions 141*c* can be elastically deformed between a contracted position (enabling the rivet 141 to be inserted through the holes 126*a* and 110*a* formed in the connection plate 126 and the lever 110), and an expanded position restoring its original shape after assembly (as shown in FIG. 4C). In this embodiment, the head portion 141*a* of the rivet is shown to be exposed outside. However, the connection plate 126 can be modified to include a counter bore 126*b* (as shown in FIG. 4B), and the head portion 141*a* can be inserted in the counter bore 126*b* to provide a wider planar contact surface.

Figure 6:
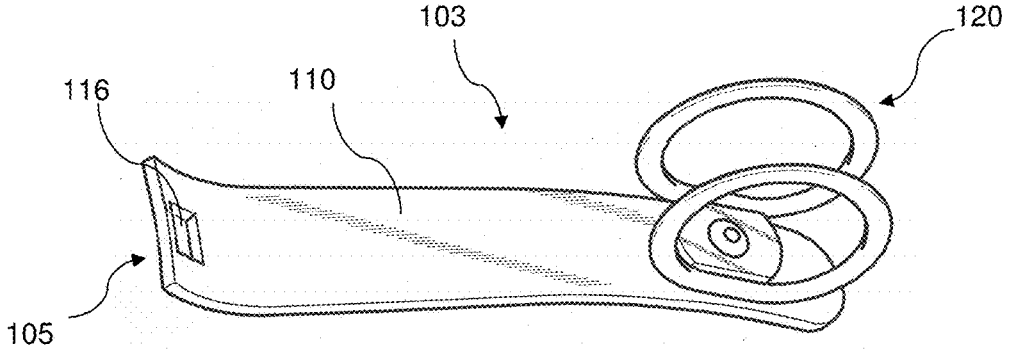
FIG. 6 is a perspective view of the operation lever unit of the nail clipper according to one preferred embodiment of the present invention, with the ring member rotatably mounted thereto.

According to one preferred embodiment, the connection plate 126 has a length (in direction parallel to the rings 122 and 124) in a range about 12 to 22 mm, a width in a range about 10 to 18 mm, and a thickness in a range about 0.2 to 0.6 mm. In order to provide suitable support space, the proximal tip portion of the operating lever 110 on which the ring member 120 is attached, has a width about the same or a bit larger than the width of the ring member 120, as illustrated in FIG. 6.

Figure 7A:
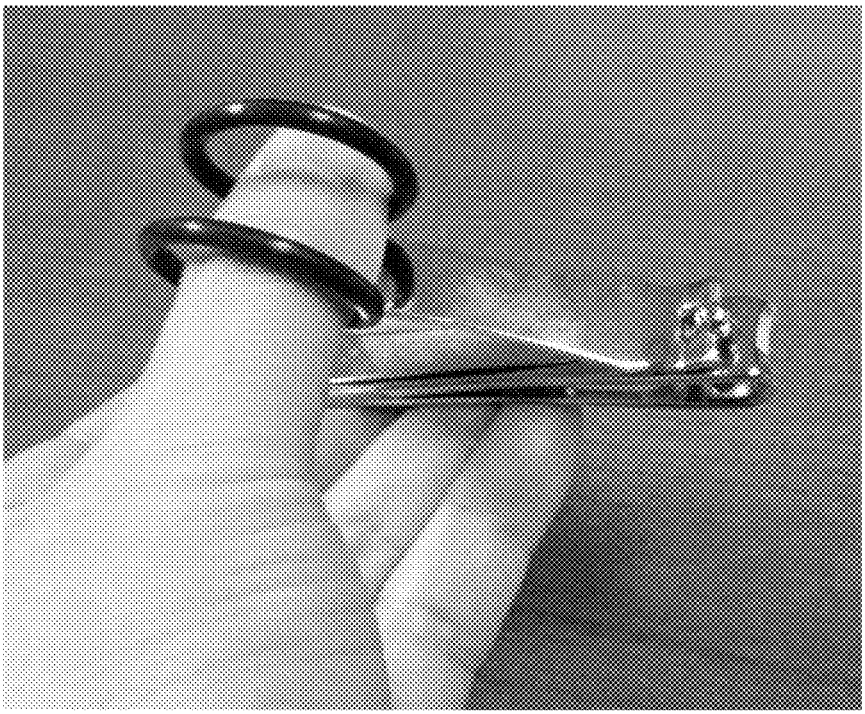
FIG. 7A is a photographic view of the nail clipper of the present invention, illustrating a usage example of the nail clipper of the present invention with the ring member in the first operating position.
Figure 7B:
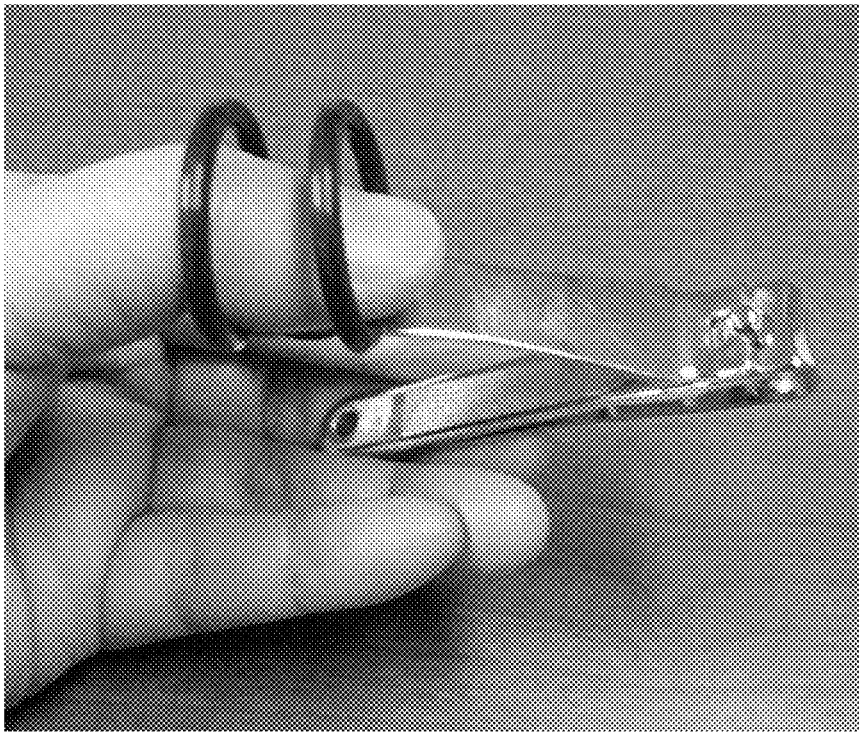
FIG. 7B is a photographic view of the nail clipper of the present invention, illustrating another usage example of the nail clipper of the present invention with the ring member in the second operating position.
Figure 7C:
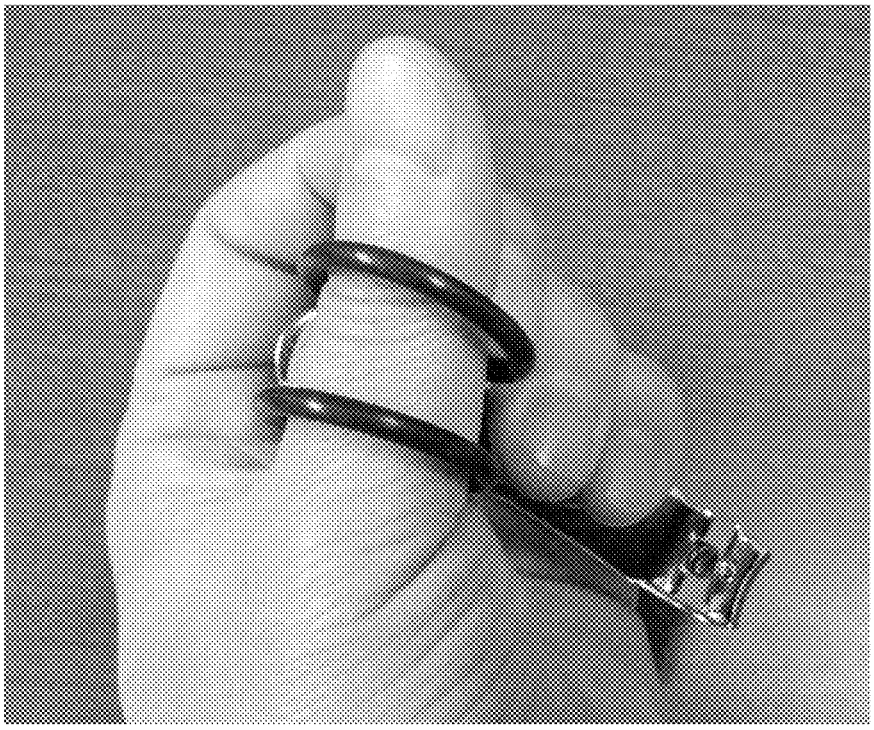
FIG. 7C is a photographic view of the nail clipper of the present invention, illustrating another usage example of the nail clipper of the present invention with the ring member in the third operating position.
Figure 8:
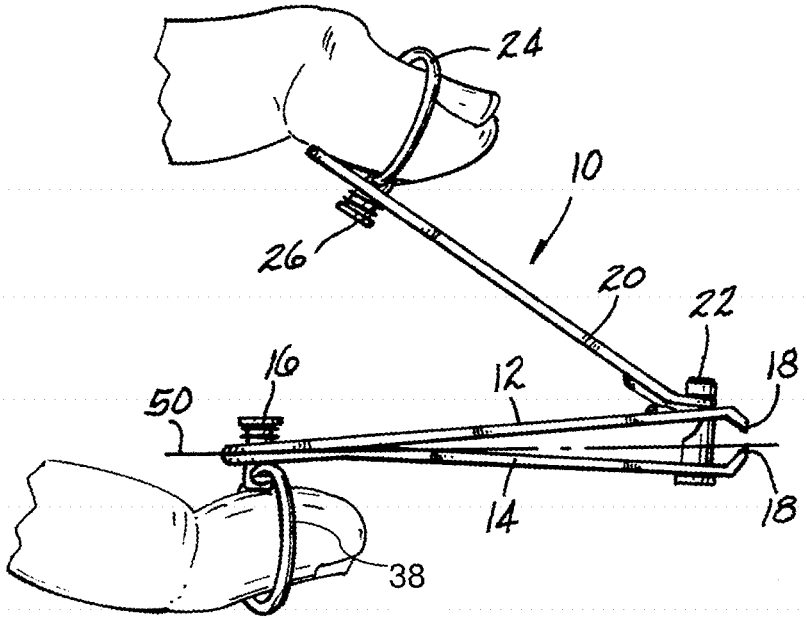
FIG. 8 (PRIOR ART)
FIG. 8 is a perspective view illustrating a nail clipper according to a prior art design.

Each bore 126*a* and 110*a* of the connection plate 126 and the lever 110 has a diameter the same as or a little larger than the corresponding body diameter of the fastening members 140 and 141. As a result, the double ring member 120 is free to rotate relative to the operating lever 110, and thus, the ring member 120 can be positioned at any desired operation positions according to the intents of the user. The operation positions can include, without limitations thereto, a first operating position (as shown in FIG. 1) with the two rings aligned in parallel relation with respect to the lever 110, and thus, enabling the thumb of the user to be placed on the lever 110 at right angle (as shown in FIG. 7A), and a second operating position (as shown in FIG. 2) with the two rings aligned in perpendicular orientation with respect to the lever 110, and thus, enabling the thumb of the user to be placed on the lever 110 in alignment to the lever 110 (as shown in FIG. 7B), and a third operating position having the thumb of the user inserted through the rings while the nail clipper is held diagonally on the palm with the last three fingers on the operation lever to apply pressure (as shown in FIG. 7C). As illustrated, the nail clipper 100 of the present invention can be comfortably placed on the multiple fingers, including the index finger, the middle finger, and others, while the thumb is securely inserted through the two parallel rings 122 and 124. Thus, this design can provide more control in the clipping operation and comfort since multiple fingers are used for firmly grasping the clipper body that can distribute pressure among the multiple fingers. As such, the design of the nail clipper of the present invention is more ergonomically satisfactory for the benefits of the users, such as individuals using the clippers for their own personal use, and commercial service providers (e.g., commercial nail care service provides) using the nail clippers routinely and more frequently for their services.

The ring member 120 (including the double rings 122 and 124 and the connection plate 126) can be formed of various structural materials, for example, such as metallic materials, rubber, and plastics or polymer materials. In one preferred embodiment, the double rings 122, 124, and the connection plate 126 of the ringer member 120 are formed into one unitary piece with a mold utilizing plastic and/or rubber molding processes known in the art. In another embodiment, the double rings 122, 124, and the connection plate 126 of the ringer member 120 are made of metallic materials (such as steel, aluminum, and bronze) and formed into one unitary piece utilizing conventional metal work processes including machining, metallurgy processes, and others.

Figure 5:
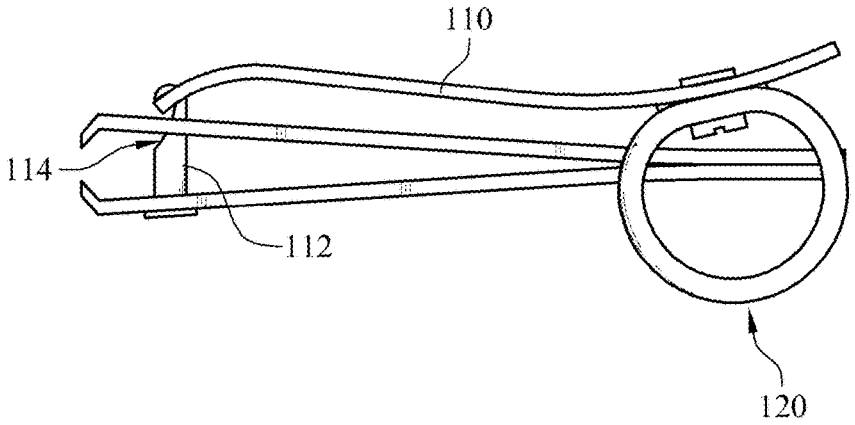
FIG. 5 is a side elevational view of the nail clipper of the present invention, with the lever and the ring member in a storing position.

FIG. 5 illustrates the nail clipper of the present invention, with the lever and the ring member in a storing position. In the storing position, the lever 110 is turned over to overlap the first and second clipper body members 102 and 104, and the two rings 122 and 124 of the double ring member are respectively positioned laterally outside of the proximal tip portion of the clipper body. This allows the nail clipper to assume a compact configuration for storage. If desired, the two rings 122 and 124 may be positioned in an alternative position (not shown), with the proximal tip portion of the clipper body inserted to the openings 125 of the two rings 122 and 124 formed of flexible materials such as rubber or resilient plastics.

With reference to FIG. 6, it is further noted that the combination of the lever 110 and the ring member 120 (that is, an operating lever unit 103 as shown) can be sold or distributed independently of the nail clipper of the present invention, and people who have their own nail clippers can replace their existing lever members with the operation lever units of the present invention. For this, the operating lever unit 103 of the present invention is designed to have a standardized lever thickness (e.g., 1-2 mm), and the hook opening 116 and the distal tip area 105 of the lever is also sized to have standardized dimensions to enable the replacement without difficulty. Moreover, the ring member 120 is also designed to be easily replaced with a new one when desired, utilizing the re-attachable fasteners 140 and 141 (FIGS. 4A-4C). Thus, the users can have a high degree of freedom in selection, as well as the enhanced convenience and comfortability in use as explained above.

As described above in connection with several exemplary embodiments thereof, the present invention is contemplated to provide a nail clipper which is simple in design, and reliable and durable in structure, while also allowing the user to safely and comfortably operate the nail clipper without the fears of accidental damage to the persons receiving the nail cut services.

The above disclosed embodiments of the invention are representatives of a presently preferred form of the invention, but are intended to be illustrative rather than definitive thereof. Accordingly, those skilled in the art will appreciate or recognize that various modifications and substitutions can be made thereto without departing from the spirit and scope of the present invention as set forth in the appended claims.

What is claimed is:

1. A nail clipper comprising:

a clipper body formed with first and second clipper body members, said first and second clipper body members each having a matching jaw portion at a distal portion thereof for clipping operation;

a lever member configured to move said match jaw portions from an opened position to a cutting position for cutting a nail inserted between said matching jaw portions;

a thumb ring member rotatably mounted to a proximal end of the lever member, the thumb ring member including first and second ring members, said first and second ring members each having a generally circular, elliptical or oval ring shape with an inner opening through which a thumb of a user is to be introduced for clipping operation, the first and second ring members disposed in parallel relation to each other with a predetermined distance there-between which is greater than a width at a proximal tip portion of the clipper body, the thumb ring member further including a connection plate member of a predetermined width and length, said connection plate member formed unitarily with the first and second ring members into one piece, and thereby connecting and bridging between a lower portion of the first and second ring members, the connection plate member having a planar upper surface and including a bore formed vertically through the connection plate member; and a fastener coupled to the bore of the connection plate member and allowing the thumb ring member to freely rotate relative to the lever member to position the thumb ring member at various operating positions, said operating positions including a first operating position with the first and second ring members aligned in parallel relation with respect to the lever member, and a second operating position with the first and second ring members aligned in perpendicular orientation with respect to the lever member, wherein the nail clipper is configured to switch to a storing position with the lever member turned over to overlap the clipper body, thereby having each of the first and second ring members positioned laterally outside of the proximal tip portion of the clipper body with the first and second ring members in the first operating position, and allowing a compact storage configuration without having the first and second ring members interfered with the clipper body.

2. The nail clipper of claim 1, wherein the connection plate member further include a counter bore at an upper side of the bore, and a head portion of the fastener is received in the counter bore so as to be generally flush with the planar upper surface of the connection plate member upon coupling, and thereby providing a wider contact surface in combination with the planar upper surface of the connection plate member.

3. The nail clipper of claim 2, wherein the fastener includes a male screw with a planar upper surface which is generally flush with the planar upper surface of the connection plate member upon coupling.

4. The nail clipper of claim 3, wherein the fastener includes a female screw member with a body diameter slightly less than the bore of the connection plate member.

5. The nail clipper of claim 1, wherein the fastener is a re-attachable rivet.

6. The nail clipper of claim 1, wherein the first and second ring members and the connection plate member of the thumb ring member are made of rubber or resilient polymer material, and unitarily formed into one piece by molding.

7. The nail clipper of claim 1, wherein the first and second ring members and the connection plate member of the thumb ring member are made of metallic material, and unitarily formed into one piece by metallurgy or metal work processes.

8. The nail clipper of claim 1, wherein the connection plate member has a length, in a direction parallel to the first and second ring members, in a range about 12 to 22 mm, a width in a range about 10 to 18 mm, and a thickness in a range about 0.2 to 0.6 mm.

9. An operation lever unit for a nail clipper having a clipper body with a pair of jaw portions to cut nail, the operation lever unit comprising:

a lever member configured to move the jaw portions of the nail clipper from an opened position to a cutting position for cutting a nail inserted between the jaw portions;

a thumb ring member rotatably mounted to a proximal end of the lever member, the thumb ring member including first and second ring members, said first and second ring members each having a generally circular, elliptical or oval ring shape with an inner opening through which a thumb of a user is to be introduced for clipping operation, the first and second ring members disposed in parallel relation to each other with a predetermined distance there-between which is greater than a width at a proximal tip portion of the clipper body, the thumb ring member further including a connection plate member of a predetermined width and length, said connection plate member formed unitarily with the first and second ring members into one piece, and thereby connecting and bridging between a lower portion of the first and second ring members, the connection plate member having a planar upper surface and including a bore formed vertically through the connection plate member; and a fastener coupled to the bore of the connection plate member and allowing the thumb ring member to freely rotate relative to the lever member to position the thumb ring member at various operating positions, said operating positions including a first operating position with the first and second ring members aligned in parallel relation with respect to the lever member, and a second operating position with the first and second ring members aligned in perpendicular orientation with respect to the lever member, wherein the nail clipper is configured to switch to a storing position with the lever member turned over to overlap the clipper body, thereby having each of the first and second ring members positioned laterally outside of the proximal tip portion of the clipper body with the first and second ring members in the first operating position, and allowing a compact storage configuration without having the first and second ring members interfered with the clipper body, wherein the connection plate member further include a counter bore at an upper side of the bore, and a head portion of the fastener is received in the counter bore so as to be generally flush with the planar upper surface of the connection plate member upon coupling, and thereby providing a wider contact surface in combination with the planar upper surface of the connection plate member.

10. The operation lever unit of claim 9, wherein the first and second ring members and the connection plate member of the thumb ring member are made of rubber or resilient polymer material, and unitarily formed into one piece by molding.

* * * * *